US008209986B2

(12) United States Patent
Lacy et al.

(10) Patent No.: US 8,209,986 B2
(45) Date of Patent: Jul. 3, 2012

(54) MULTI-TUBE THERMAL FUSE FOR NOZZLE PROTECTION FROM A FLAME HOLDING OR FLASHBACK EVENT

(75) Inventors: Benjamin Paul Lacy, Greer, SC (US); Lewis Berkley Davis, Jr., Niskayuna, NY (US); Thomas Edward Johnson, Greer, SC (US); William David York, Greer, SC (US)

(73) Assignee: General Electric Company, Schenectady, NY (US)

( * ) Notice: Subject to any disclaimer, the term of this patent is extended or adjusted under 35 U.S.C. 154(b) by 687 days.

(21) Appl. No.: 12/260,451

(22) Filed: Oct. 29, 2008

(65) Prior Publication Data

US 2010/0139280 A1 Jun. 10, 2010

(51) Int. Cl.
*F02C 1/00* (2006.01)

(52) U.S. Cl. ..... 60/737; 60/740; 60/746; 60/747; 60/748; 29/890.143

(58) Field of Classification Search ..... 60/740, 60/746, 747, 748, 737; 29/890.143
See application file for complete search history.

(56) References Cited

U.S. PATENT DOCUMENTS 4,100,733 A * 7/1978 Striebel et al. ..... 60/39.463
4,966,001 A * 10/1990 Beebe ..... 60/737
5,263,325 A * 11/1993 McVey et al. ..... 60/738
5,685,139 A * 11/1997 Mick et al. ..... 60/776
5,881,756 A * 3/1999 Abbasi et al. ..... 137/9
6,003,296 A * 12/1999 Citeno et al. ..... 60/772
6,179,608 B1 * 1/2001 Kraemer et al. ..... 431/9
6,267,585 B1 * 7/2001 Suttrop ..... 431/354
6,429,020 B1 * 8/2002 Thornton et al. ..... 436/153
6,698,207 B1 * 3/2004 Wiebe et al. ..... 60/737
6,786,047 B2 * 9/2004 Bland et al. ..... 60/737
7,370,466 B2 * 5/2008 Cai ..... 60/39.11
2009/0241508 A1 * 10/2009 Davis et al. ..... 60/39.091
2010/0293954 A1 * 11/2010 Widener ..... 60/740

OTHER PUBLICATIONS

Benjamin Paul Lacy, et al. "A Pre-Mixing Apparatus for a Turbine Engine". U.S. Appl. No. 12/169,865, filed Jul. 9, 2008.

* cited by examiner

*Primary Examiner* — Louis Casaregola
*Assistant Examiner* — Michael B Mantyla
(74) *Attorney, Agent, or Firm* — Cantor Colburn LLP

(57) ABSTRACT

A protection system for a pre-mixing apparatus for a turbine engine, includes: a main body having an inlet portion, an outlet portion and an exterior wall that collectively establish a fuel delivery plenum; and a plurality of fuel mixing tubes that extend through at least a portion of the fuel delivery plenum, each of the plurality of fuel mixing tubes including at least one fuel feed opening fluidly connected to the fuel delivery plenum; at least one thermal fuse disposed on an exterior surface of at least one tube, the at least one thermal fuse including a material that will melt upon ignition of fuel within the at least one tube and cause a diversion of fuel from the fuel feed opening to at least one bypass opening. A method and a turbine engine in accordance with the protection system are also provided.

17 Claims, 11 Drawing Sheets

MULTI-TUBE THERMAL FUSE FOR NOZZLE PROTECTION FROM A FLAME HOLDING OR FLASHBACK EVENT

STATEMENT OF GOVERNMENT SPONSORED RESEARCH

This invention was made with Government support under Contract No. DE-FC26-05NT4263, awarded by the US Department of Energy (DOE). The Government has certain rights in this invention.

BACKGROUND OF THE INVENTION

1. Field of the Invention

Exemplary embodiments of the invention pertain to the art of turbomachine combustion systems and, more particularly, to a flame suppression system for protecting a multi-tube nozzle.

2. Description of the Related Art

In general, gas turbine engines combust a fuel/air mixture that releases heat energy to form a high temperature gas stream. The high temperature gas stream is channeled to a turbine via a hot gas path. The turbine converts thermal energy from the high temperature gas stream to mechanical energy that rotates a turbine shaft. The shaft may be used in a variety of applications, such as for providing power to a pump or an electrical generator.

In a gas turbine, engine efficiency increases as combustion gas stream temperatures increase. Unfortunately, higher gas stream temperatures produce higher levels of nitrogen oxides (NOx), an emission that is subject to both federal and state regulation. Therefore, there exists a careful balancing act between operating gas turbines in an efficient range, while also ensuring that the output of NOx remains below mandated levels.

Low NOx levels can be achieved by ensuring very good mixing of the fuel and air and burning a lean mixture. Various techniques, such as Dry-Low NOx (DLN) combustors including lean premixed combustors and lean direct injection combustors, are used to ensure proper mixing. In turbines that employ lean pre-mixed combustors, fuel is pre-mixed with air in a pre-mixing apparatus prior to being admitted to a reaction or combustion zone. Pre-mixing reduces peak combustion temperatures and, as a consequence, also reduces NOx output. However, depending on the particular fuel employed, pre-mixing may cause auto-ignition, flashback and/or flame holding within the pre-mixing apparatus. As one might imagine, cases of auto-ignition, flashback and/or flame holding within the pre-mixing apparatus can be damaging to machine components. At a minimum, such conditions can affect emissions as well as performance of the combustion system, and may result in degradation or destruction of equipment.

Thus, what are needed are methods and apparatus for addressing problems associated with auto-ignition, flashback and/or flame holding within the pre-mixing apparatus.

BRIEF DESCRIPTION OF THE INVENTION

In one embodiment, the invention provides a protection system for a pre-mixing apparatus for a turbine engine, that includes: a main body having an inlet portion, an outlet portion and an exterior wall that collectively establish at least one fuel delivery plenum; and a plurality of fuel mixing tubes that extend through at least a portion of the at least one fuel delivery plenum, each of the plurality of fuel mixing tubes including at least one fuel feed opening fluidly connected to the at least one fuel delivery plenum; at least one thermal fuse disposed on an exterior surface of at least one tube, the at least one thermal fuse including a material that will melt upon an ignition of fuel within the at least one tube and cause a diversion of fuel from the fuel feed opening to at least one bypass opening.

In another embodiment, the invention provides a method of fabricating a pre-mixing apparatus for delivering fuel to a combustion chamber, that includes: selecting a pre-mixing apparatus including a main body having an inlet portion, an outlet portion and an exterior wall that collectively establish at least one fuel delivery plenum; and a plurality of fuel mixing tubes that extend through at least a portion of the at least one fuel delivery plenum, each of the plurality of fuel mixing tubes including at least one fuel feed opening fluidly connected to the at least one fuel delivery plenum; selecting a fuse material for installing at least one thermal fuse into the pre-mixing apparatus; and disposing at least one thermal fuse on an exterior surface of at least one tube of the pre-mixing apparatus.

In a further embodiment, the invention provides a turbine engine that includes: at least one source of fuel; at least one source of combustion air; an apparatus for mixing the at fuel with the combustion air, the apparatus including a main body having an inlet portion, an outlet portion and an exterior wall that collectively establish at least one fuel delivery plenum; and a plurality of fuel mixing tubes that extend through at least a portion of the at least one fuel delivery plenum, each of the plurality of fuel mixing tubes including at least one fuel feed opening fluidly connected to the at least one fuel delivery plenum; at least one thermal fuse disposed on an exterior surface of at least one tube, the at least one thermal fuse including a material that will melt upon an ignition of fuel within the at least one fuel mixing tube and cause a diversion of fuel from the fuel feed opening to at least one bypass opening.

DETAILED DESCRIPTION OF THE INVENTION

Disclosed herein are methods and apparatus for providing flame holding and flashback protection in a multi-tube feed injector for a turbine engine. In order to provide context for the teachings herein, an exemplary embodiment of the turbine engine and aspects of an exemplary embodiment of the multi-tube feed injector are provided in FIG. 1 through FIG. 4.

Figure 1:
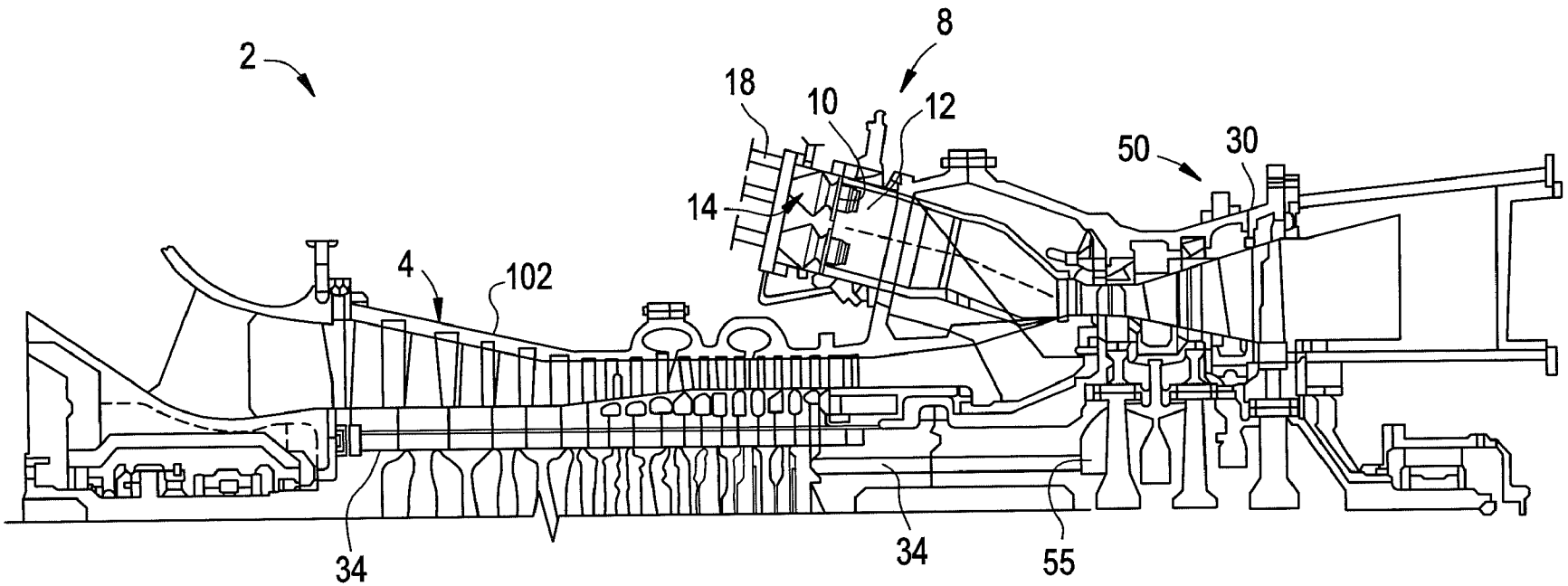
FIG. 1 is a cross-sectional side view of an exemplary gas turbine engine including a fuel feed nozzle constructed in accordance with an exemplary embodiment of the invention.

FIG. 1 is a schematic illustration of an exemplary gas turbine engine 2. Engine 2 includes a compressor 4 and a combustor assembly 8. Combustor assembly 8 includes a combustor assembly wall 10 that at least partially defines a combustion chamber 12. At least one pre-mixing apparatus or nozzle 14 extends through combustor assembly wall 10 and leads into combustion chamber 12. As will be discussed more fully below, nozzle 14 receives a first fluid or fuel through a fuel inlet 18 and a second fluid or compressed air from compressor 4. The fuel and compressed air are mixed, passed into combustion chamber 12 and ignited to form a high temperature, high pressure combustion product or air stream. Although only a single combustor assembly 8 is shown in the exemplary embodiment, engine 2 may include a plurality of combustor assemblies 8. In any event, engine 2 also includes a turbine 30 and a compressor/turbine shaft 34 (sometimes referred to as a rotor). In a manner known in the art, turbine 30 is coupled to, and drives, shaft 34 that, in turn, drives compressor 4.

In operation, air flows into compressor 4 and is compressed into a high pressure gas. The high pressure gas is supplied to combustor assembly 8 and mixed with fuel, for example process gas and/or synthetic gas (syngas), in nozzle 14. The fuel/air or combustible mixture is passed into combustion chamber 12 and ignited to form a high pressure, high temperature combustion gas stream. Alternatively, combustor assembly 8 can combust fuels that include, but are not limited to natural gas and/or fuel oil. In any event, combustor assembly 8 channels the combustion gas stream to turbine 30 which coverts thermal energy to mechanical, rotational energy.

Figure 2:
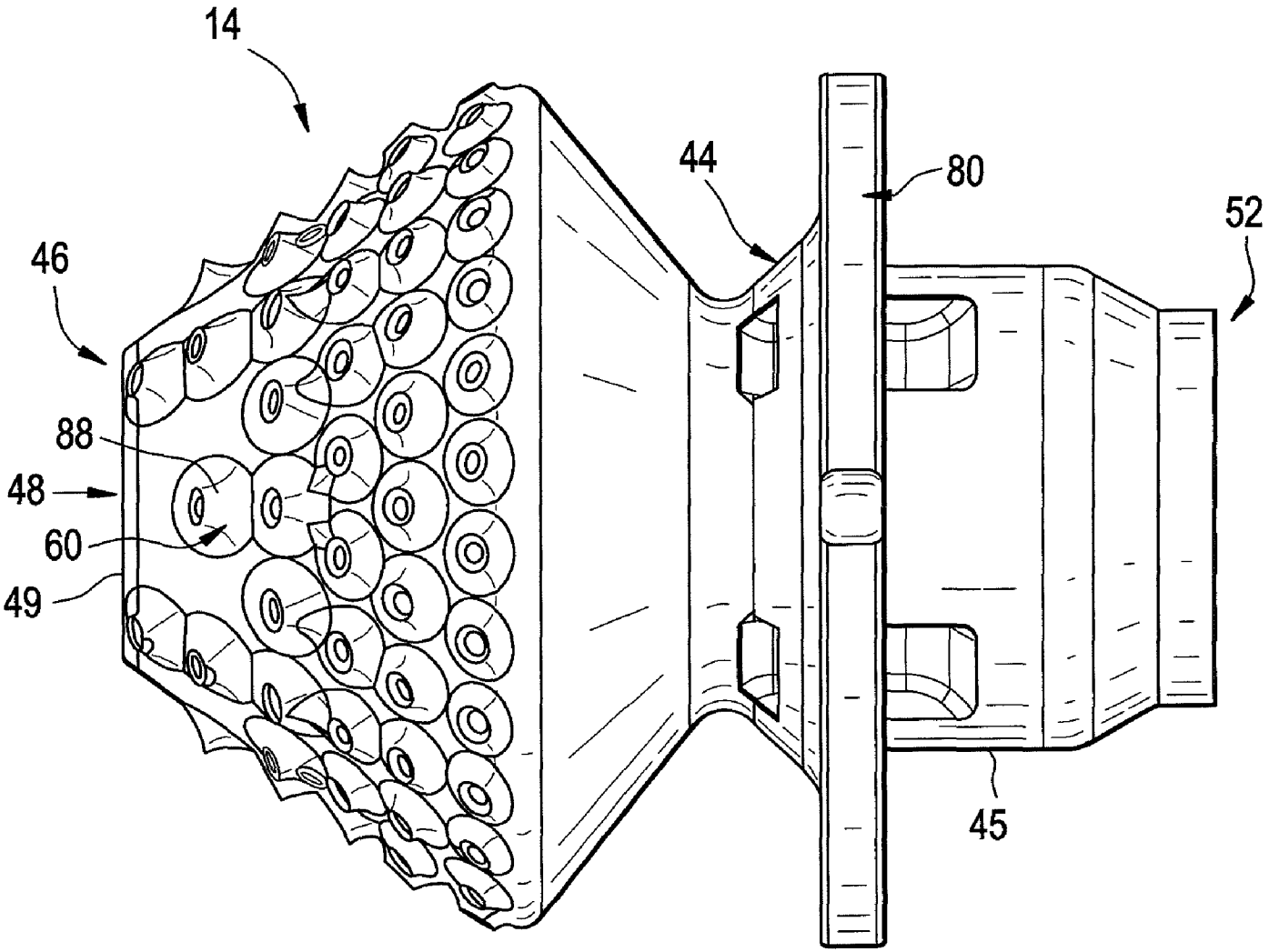
FIG. 2 is a side elevational view of the nozzle depicted in FIG. 1.
Figure 3:
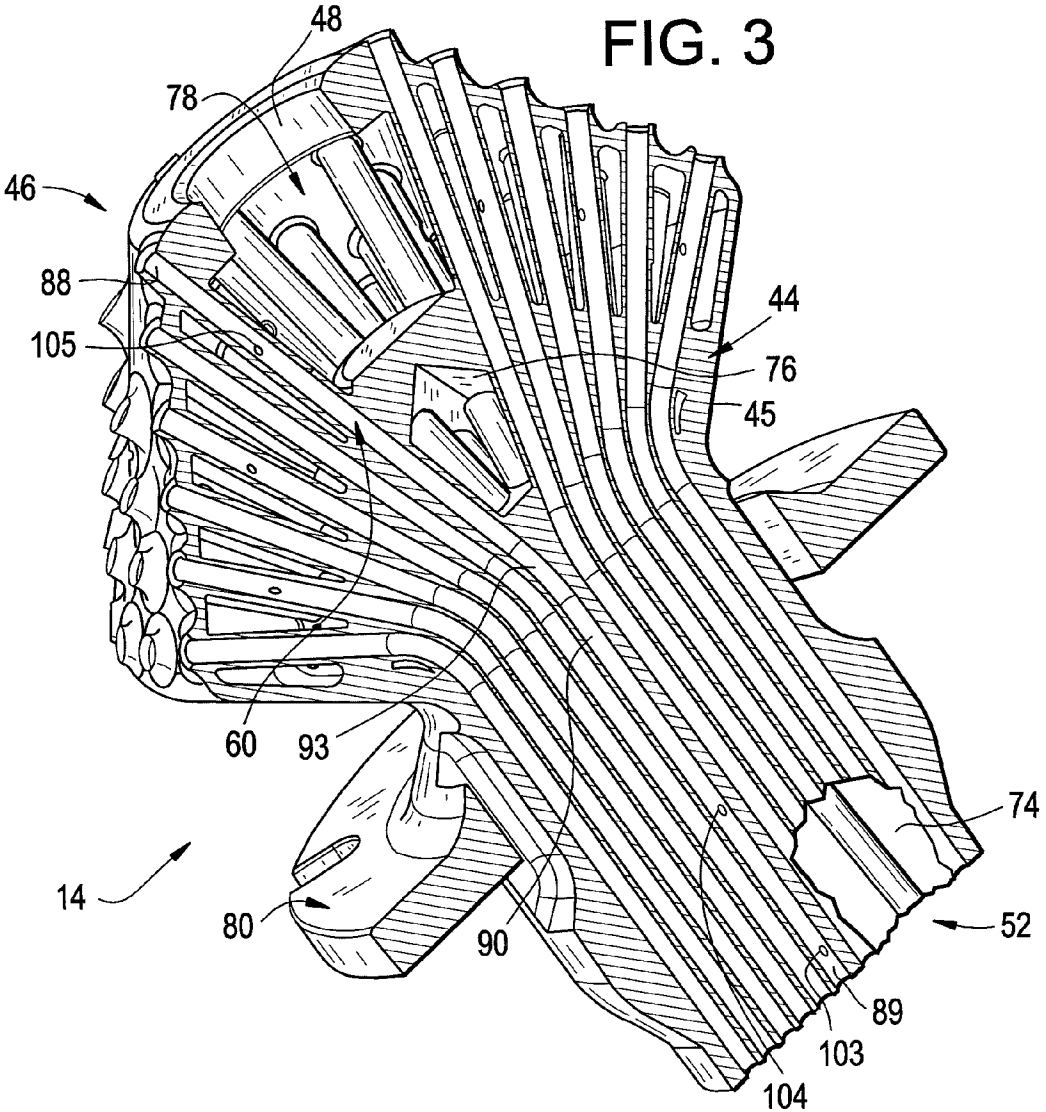
FIG. 3 is a cross-sectional side view of the nozzle of FIG. 2.
Figure 4:
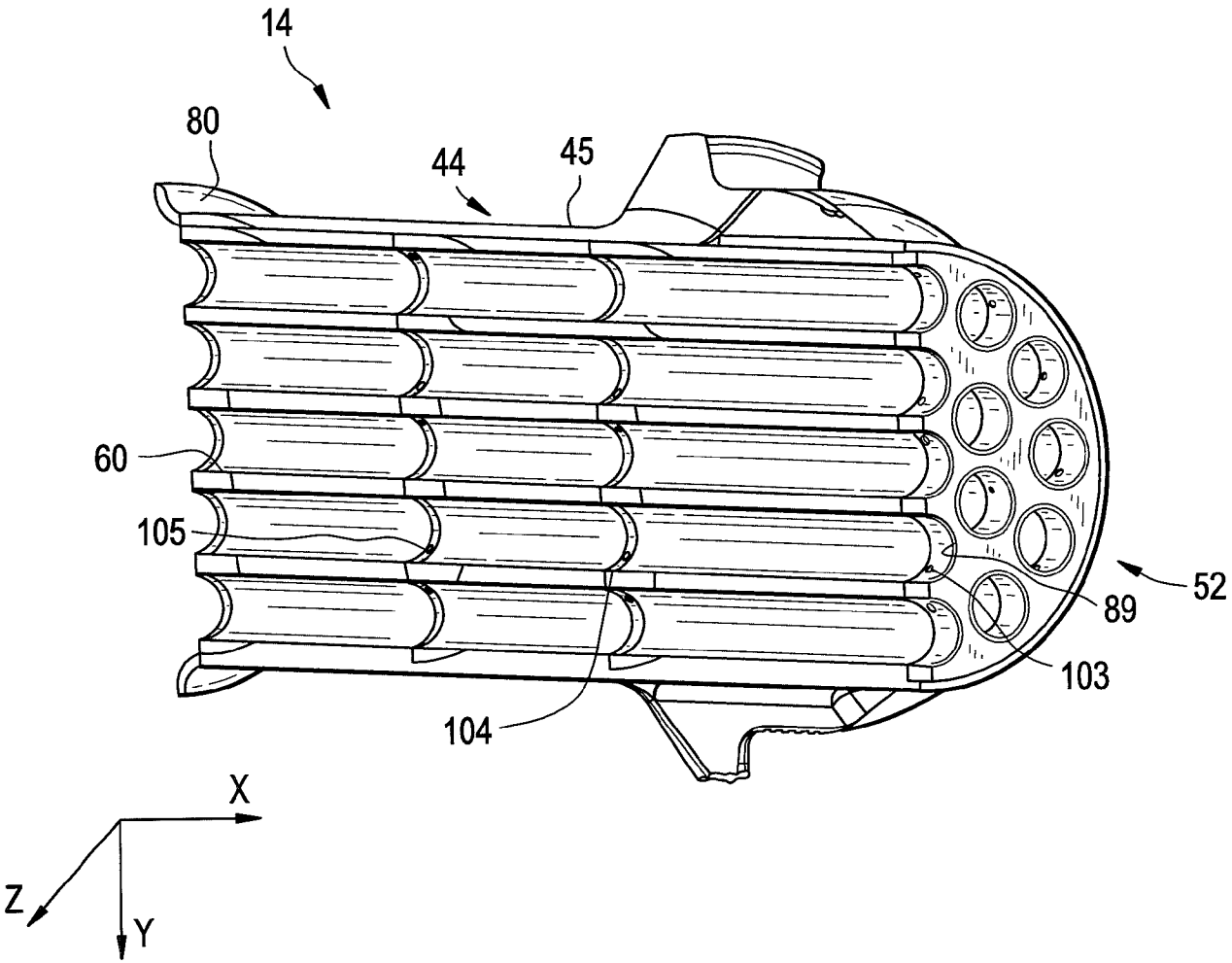
FIG. 4 is a cross-sectional perspective view of an outlet portion of the nozzle and depicts fuel delivery openings.

Reference will now be made to FIGS. 2-4 in describing nozzle 14 constructed in accordance with an exemplary embodiment of the invention. As shown, nozzle 14 includes a main body 44 having an exterior wall 45 that defines an inlet portion 46 including a first fluid inlet 48, and an outlet portion 52 from which the combustible mixture passes into combustion chamber 12. Nozzle 14 further includes a plurality of fluid delivery or mixing tubes, one of which is indicated at 60, that extend between inlet portion 46 and outlet portion 52 as well as a plurality of fluid delivery plenums 74, 76 and 78 that selectively deliver a first fluid and or other substances to delivery tubes 60 as will be discussed more fully below. In the exemplary embodiment shown, plenum 74 defines a first plenum arranged proximate to outlet portion 52, plenum 76 defines an intermediate plenum arranged centrally within nozzle 14 and plenum 78 defines a third plenum arranged proximate to inlet portion 46. Finally, nozzle 14 is shown to include a mounting flange 80. Mounting flange 80 is employed to secure nozzle 14 to combustor assembly wall 10.

Tube 60 provides a passage for delivering the second fluid and the combustible mixture into combustion chamber 12. It should be understood that more than one passage per tube could be provided, with each tube 60 being formed at a variety of angles depending upon operating requirements for engine 2 (FIGS. 2 and 3). Of course tube 60 can also be formed without angled sections such as shown in FIG. 4. As will become evident below, each tube 60 is constructed to ensure proper mixing of the first and second fluids prior to their introduction into combustion chamber 12. Towards that end, each tube 60 includes a first or inlet end section 88 provided at inlet portion 46, a second or outlet end section 89 provided at outlet portion 52 and an intermediate section 90.

In accordance with the exemplary embodiment shown, tube 60 includes a generally circular cross-section having a diameter that is sized based on enhancing performance and manufacturability. As will be discussed more fully below, the diameter of tube 60 could vary along a length of tube 60. In accordance with one example, tube 60 is formed having a diameter of approximately 2.5 mm to about 22 mm or larger. Tube 60 also includes a length that is approximately ten (10) times the diameter. Of course, the particular diameter and length relationship can vary depending on the particular application chosen for engine 2. In further accordance with the embodiment shown, intermediate section 90, shown in FIGS. 2 and 3, includes an angled portion 93 such that inlet end section 88 extends along an axis that is offset relative to outlet end section 89. Angled portion 93 facilitates mixing of the first and second fluids by creating a secondary flow within tube 60. In addition to facilitating mixing, angled portion 93 creates space for plenums 74, 76 and 78. Of course, tube 60 could be formed without angled portion 93 depending upon construction and/or operation needs, as shown in FIG. 4, with first fluid inlet 48 is located at side portions thereof or the like.

In accordance with the exemplary embodiment illustrated in FIGS. 1-4, each tube 60 includes a first fluid delivery opening 103 arranged proximate to outlet end section 89 and fluidly connected to first plenum 74, a second fluid delivery opening 104 arranged along intermediate section 90 and fluidly connected to second plenum 76 and a third fluid delivery opening 105 arranged substantially spaced from inlet end section 88 and upstream of first and second fluid delivery openings 103 and 104. Third fluid delivery opening 105 is fluidly connected to third plenum 78. Fluid delivery openings 103-105 could be formed at a variety of angles depending upon the particular application in which engine 2 is employed. In accordance with one exemplary aspect of the invention, a shallow angle is employed in order to allow the fuel to assist the air flowing through tube 60 and reduce pressure drop through the tube 60. In addition, a shallow angle reduces any potential disturbances in the air flow caused by a fuel jet. In accordance with another exemplary aspect, tube 60 is formed having a decreasing diameter that creates a region of higher velocity flow at, for example, first fluid delivery opening 103 to reduce flame holding potential. The diameter then increases downstream to provide pressure recovery. With this arrangement, first fluid delivery opening 104 enables recessed, lean direct injection of the combustible mixture, second fluid delivery opening 103 enables a partially pre-mixed combustible mixture injection and third fluid delivery opening 105 enables fully premixed combustible mixture delivery into combustion chamber 12.

More specifically, first fluid delivering opening 103 enables the introduction of the first fluid or fuel into tube 60, which already contains a stream of second fluid or air. The particular location of first fluid delivery opening 103 ensures that the first fluid mixes with the second fluid just prior to entering combustion chamber 12. In this manner, fuel and air remain substantially unmixed until entering combustion chamber 12. Second fluid delivery opening 104 enables the introduction of the first fluid into the second fluid at a point spaced from outlet end section 89. By spacing second first fluid delivery opening 104 from outlet end section 89, fuel and air are allowed to partially mix prior to being introduced into combustion chamber 12. Finally, third fluid delivery opening 105 is substantially spaced from outlet end section 89 and preferably up-stream from angled portion 93, so that the first fluid and second fluid are substantially completely pre-mixed prior to being introduced into combustion chamber 12. As the fuel and air travel along tube 60, angled portion 93 creates a swirling action that contributes to mixing. In addition to forming fluid delivery openings 103-105 at a variety of angles, protrusions could be added to each tube 60 that direct the fluid off of tube walls (not separately labeled). The protrusions can be formed at the same angle as the corresponding fluid delivery opening 103-105 or at a different angle in order to adjust an injection angle of incoming fluid.

With this overall arrangement, fuel is selectively delivered through first fluid inlet 48 and into one or more of plenums 74, 76 and 78 to mix with air at different points along tube 60 in order to adjust the fuel/air mixture and accommodate differences in ambient or operating conditions. That is, fully mixed fuel/air tends to produce lower NOx levels than partially or un-mixed fuel/air. However, under cold start and/or turn down conditions, richer mixtures are preferable. Thus, exemplary embodiments of the invention advantageously provide for greater control over combustion byproducts by selectively controlling the fuel/air mixture in order to accommodate various operating or ambient conditions of engine 2.

In addition to selectively introducing fuel, other substances or diluents can be introduced into the fuel/air mixture to adjust combustion characteristics. That is, while fuel is typically introduced into third plenum 78, diluents can be introduced into, for example, second plenum 76 and mixed with the fuel and air prior to being introduced into combustion chamber 12. Another benefit of the above-arrangement is that fuel or other substances in plenums 74, 76 and 78 will cool the fuel/air mixture passing through tube 60 quenching the flame and thus provide better flame holding capabilities. In any event, while there are obvious benefits to multiple plenums and delivery openings, it should be understood that nozzle 14 could be formed with a single fuel delivery opening fluidly connected to a single fuel plenum that is strategically positioned to facilitate efficient combustion in order to accommodate various applications for engine 2.

Now with regard to thermal protection of the nozzle 14, in some instances, a flame holding event or a flashback event may occur during operation. That is, certain problems such as fuel inconsistencies (i.e., introduction of limited quantities of low-flashpoint fuel), sparking and other issues may cause ignition (i.e., operational anomalies, broadly referred to as an "event") of the mixture of fuel and air within the tube 60 and prior to injection into the combustion chamber 12. Accordingly, various embodiments of thermal protection of the nozzle 14 are provided.

In general, thermal protection is described herein such that when a flame holding event or flashback event occurs, a feature, such as a thermal fuse, activates (i.e., melts) and limits further damage to the rest of the nozzle. Further damage is limited by bypassing fuel around the problem region and allowing some level of continued operability until the nozzle 14 can be repaired or replaced.

First, it should be recognized that the foregoing exemplary embodiments of FIGS. 1-4 are merely illustrative of the engine 2, the nozzle 14 and the various related aspects. Accordingly, the protection schemes provided herein are not limited to the embodiments shown in FIGS. 6-13.

Figure 5:
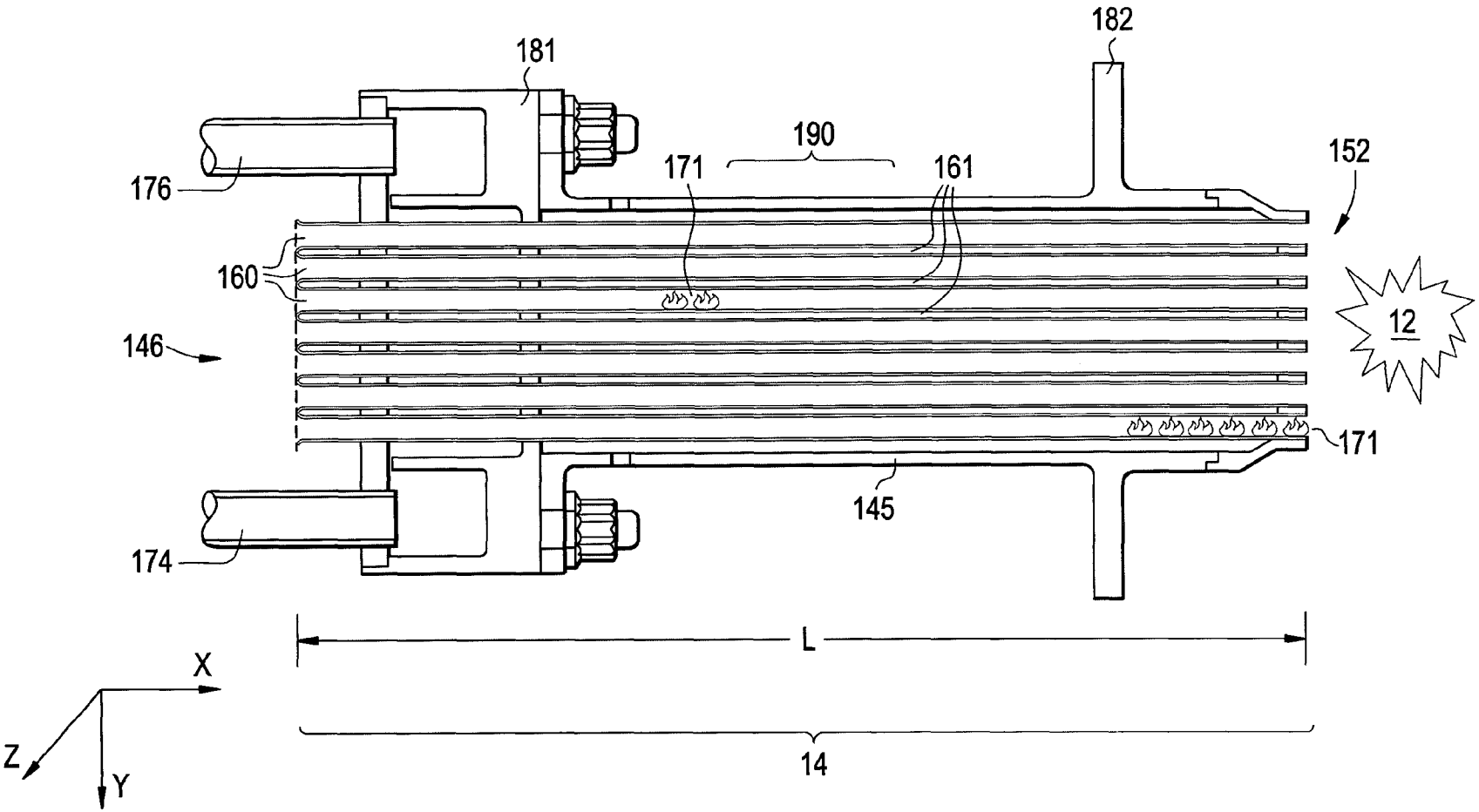
FIG. 5 is a cross-sectional side view of another embodiment of the nozzle, and depicts operational anomalies including a flame holding event and flashback.

Now with reference to FIG. 5, there is shown an example of another embodiment of the nozzle 14. In this embodiment, the nozzle 14 includes a plurality of tubes 160 for delivering air to the combustion chamber 12 through an outlet portion 152. The plurality of tubes 160 are bounded by an external wall 145 of the fuel plenum and include an elongated intermediate section 190. Between the plurality of tubes 160 is a fuel plenum space 161. Integrated to the external fuel plenum wall 145 and located axially along a length of the nozzle 14 are a first mounting flange 181 and a second mounting flange 182. Generally, the first mounting flange 181 and the second mounting flange 182 provide for secure installation of the nozzle 14. The nozzle 14 includes an inlet portion 146. The nozzle includes a first fluid delivery plenum 174 and a second fluid delivery plenum 176.

Generally, air is directed through the inlet portion 146 and into the plurality of tubes 160. Fuel enters the plurality of tubes 160 from the fuel plenum space 161 through various fuel feed openings (depicted in FIGS. 6-13). In FIG. 5, two events 171 are shown. These include a flame holding event 171 in a mid-portion of one tube 160, and flashback event 171 (from the combustion chamber 12) in another tube 160. It should be recognized that these examples of events 171 are merely illustrative of two forms of an event 171. Regardless of form, it is desired that such events 171 be extinguished as quickly as possible to protect the nozzle 14, prevent early or catastrophic ignition of the fuel supply, and to limit poor combustion conditions.

Varying the length L of the nozzle 14 affords designers opportunity to control mixing of fuel and aspects combustion. Accordingly, designers may favor embodiments with "lean direct injection" (LDI), where a substantial amount of fuel is injected into the plurality of tubes 160 at or near the outlet portion 152, "premixed direct injection" (PDI) where a substantial amount of fuel is injected into the plurality of tubes 160 upstream of the outlet portion 152, resulting in thorough and substantial mixing of fuel and air, and other forms of injection.

Figure 6:
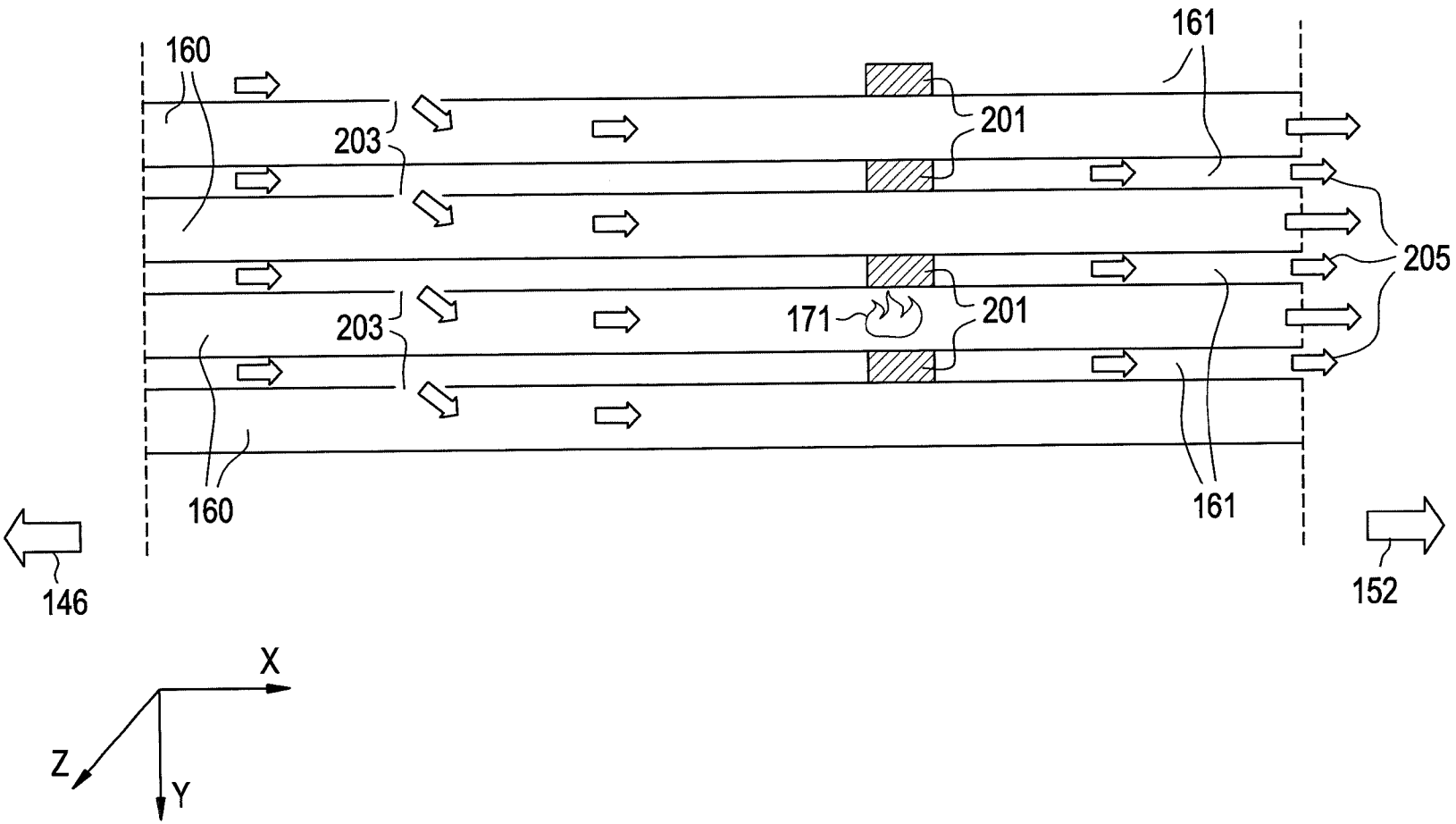
FIG. 6 is a partial cross-sectional side view of the nozzle depicted in FIG. 5 with addition of a thermal fuse, and further shows aspects of operation of the thermal fuse as a thermal protection system.

Prior to discussing FIGS. 6-13, first consider general aspects of thermal protection for the nozzle 14. In general, the nozzle 14 includes thermal protection features in the form of a thermal fuse and at least one bypass opening. In normal operation, fuel in the fuel plenum space 161 enters each tube 160 through at least one fuel feed opening (i.e., an opening in the side of the tube 160). Located downstream of the fuel feed opening is at least one thermal fuse. Generally, at least one bypass opening is located proximate, adjacent, after or in some similar relation to the at least one thermal fuse. When the event 171 is initiated, a melting (also referred to as an "activation") of the thermal fuse occurs. As a result, a flow of fuel within the nozzle 14 changes. That is, a substantial portion of the fuel will pass the at least one fuel feed opening, generally cross a prior location for the thermal fuse (a location blocked by the thermal fuse prior to melting), and exit through the at least one bypass opening. Note that in illustrations provided in FIGS. 6-13, fuel and air generally flow in what is depicted as an X-direction. A first embodiment of the thermal protection features is shown in FIG. 6.

FIG. 6 depicts aspects of an embodiment of the nozzle 14 that includes the thermal protection features. Note that this illustration depicts only a cutaway portion of the plurality of tubes 160 and the fuel plenum space 161. In this example, downstream of the inlet portion 146, each tube 160 includes a fuel feed opening 203. Further downstream is a single thermal fuse 201, also referred to as a "unitary fuse," a "shared fuse" and by other similar terms. The unitary thermal fuse 201 generally surrounds each tube 160 and spans the entire fuel plenum space 161 (a shared thermal fuse 201 may not span the entire fuel space plenum 161). This effectively blocks communication of fuel past the thermal fuse 201 while the thermal fuse 201 is intact. Ultimately, fuel exits through the outlet portion 152.

Fuel normally flows through the fuel feed opening 203 into a respective tube 160 to mix with air coming from the inlet portion 146. If a flame holding event 171 occurs, the thermal fuse 201 will activate by melting in the vicinity of the tube 160 that contains the flame holding event 171. As a result, the thermal fuse 201 will no longer block the fuel plenum space 161 in the vicinity of the tube 160. Accordingly, at least a portion of the fuel enters the fuel plenum space 161 downstream of the thermal fuse 201 (e.g., where the thermal fuse 201 was located), and ultimately exits the nozzle 14 directly through a bypass opening 205, which, is included in the outlet portion 152. Note that in this embodiment, the bypass opening 205 is realized as a single opening (that is, as an open face) spanning the outlet portion 152, though there could be multiple connected openings spanning outlet portion 152 as well. That is, in some embodiments, a face of the outlet portion 152 may not be open, and could include a plate (such as to support the tubes 160), where the plate (not shown) includes multiple holes in it to allow the fuel to exit the nozzle 14.

Upon activation of the thermal fuse 201, the fuel will now largely bypass the fuel feed openings 203 and therefore the flame event 171 will be effectively starved of fuel. Thus, the nozzle 14 will be protected from the added heat load and the resulting degradation.

Figure 7:
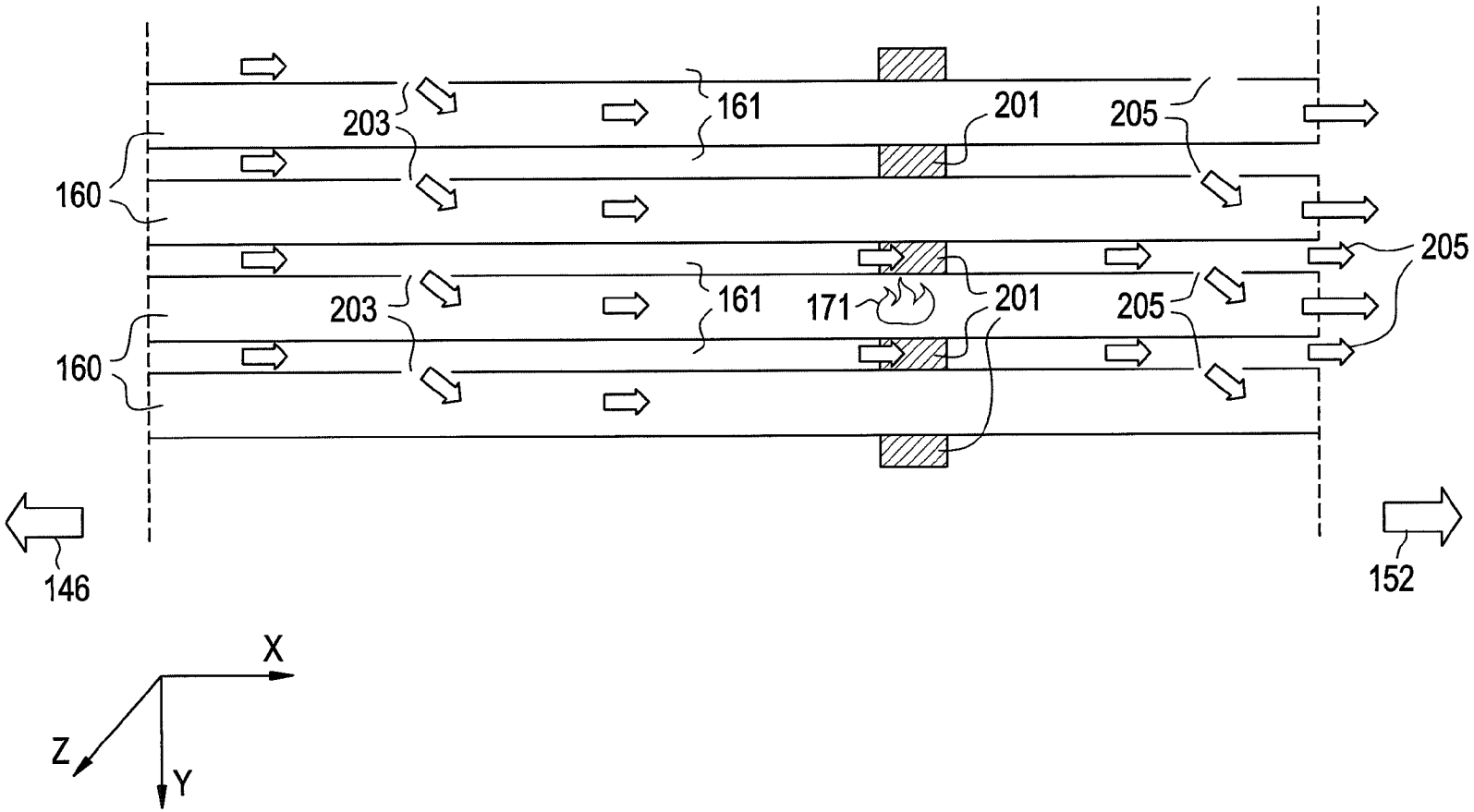
FIGS. 7-13 depict further embodiments of the thermal fuse.

FIG. 7 depicts aspects of another embodiment of the nozzle 14 including the thermal protection features. Like the embodiment of FIG. 6, each tube 160 includes the fuel feed opening 203. Further downstream is the unitary thermal fuse 201, and beyond that is a plurality of bypass openings 205. In normal operation, fuel exits the outlet portion 152 through each tube 160. While the thermal fuse 201 remains intact, the bypass openings 205 remain dormant.

As in the example of FIG. 6, when the flame holding event 171 occurs, the thermal fuse 201 will activate by melting in the vicinity of the tube 160 that contains the event 171. As a result, a portion of the thermal fuse 201 is removed and no longer blocks a portion of the fuel plenum space 161 that surrounds the tube 160. Thus, the activation (i.e., melting) of a portion of the unitary thermal fuse 201 allows fuel to bypass the fuel feed opening 203 for the effected tube 160.

The melting of the portion of the unitary thermal fuse 201 permits at least some of the fuel to distribute within the fuel plenum space 161 (i.e., in a Y direction) downstream of the thermal fuse 201. Accordingly, the fuel will enter into the bypass opening 205 for the tube 160 that contains the event 171, and some of the fuel may also enter bypass openings 205 for other tubes 160 close by. As a result of activation of the thermal fuse 201, the fuel will largely bypass the fuel feed opening 203 for the effected tube 160 and the flame event 171 will be effectively starved. This embodiment provides an advantage of retaining at least some of capability for the nozzle 14 by allowing some fuel/air mixing to occur prior to the mixture exiting from the nozzle 14.

Figure 8:
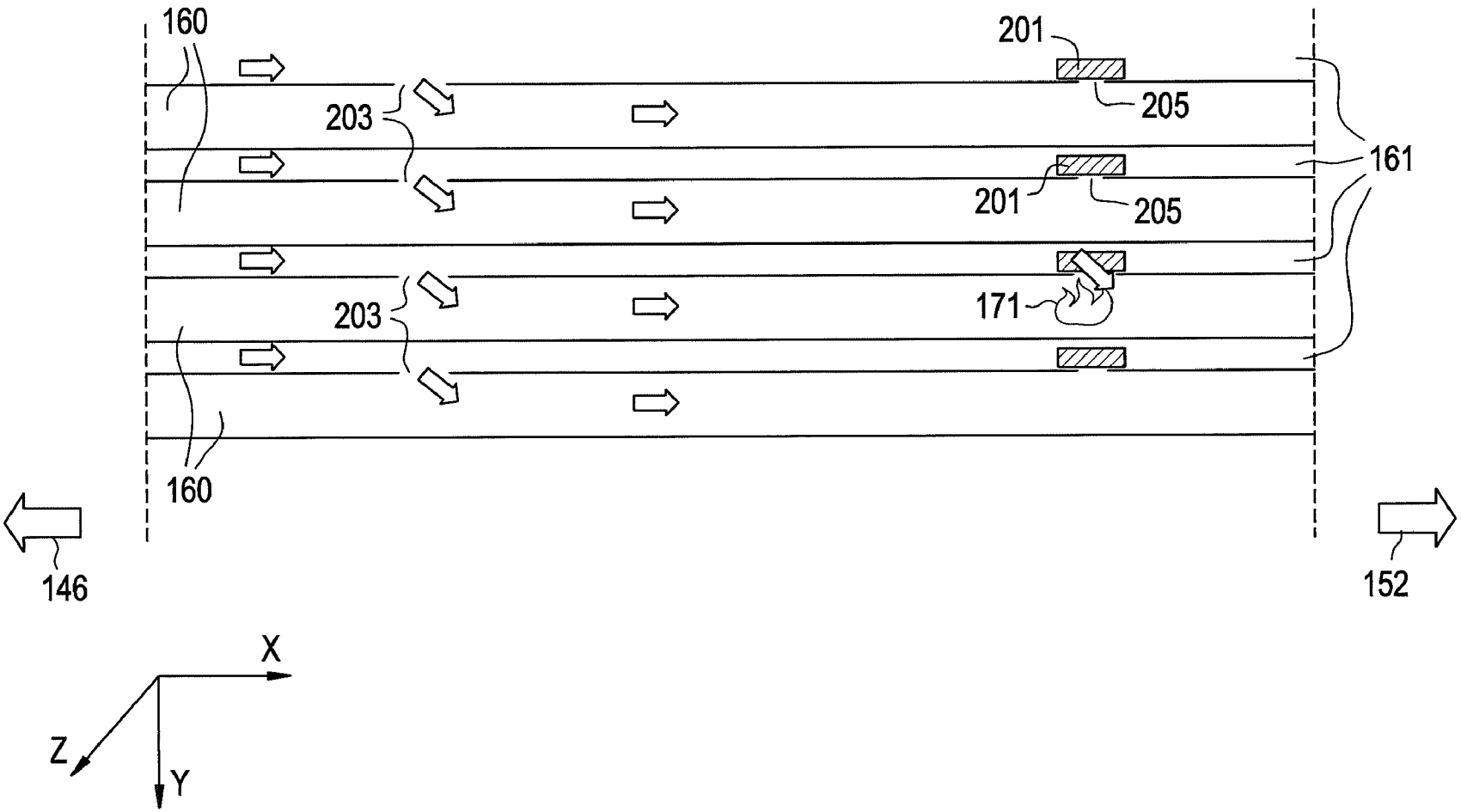

FIG. 8 depicts aspects of another embodiment where the thermal protection features are implemented. In this example, a plurality of low-profile thermal fuses 201 are employed. Each of the low-profile thermal fuses 201 individually cover a respective bypass opening 205. In normal operation, fuel flows through each of the fuel feed openings 203 into a respective tube 160. The fuel then mixes with air coming from the inlet portion 146. In the event of a flame holding event 171, the low-profile thermal fuse 201 protecting the tube 160 containing the event 171 will activate by melting. This allows fuel to bypass the fuel feed opening 203 and enter into the bypass opening 205. Since some of the fuel will now bypass the fuel feed opening 203, the event 171 will be effectively starved, thus protecting nozzle 14 from the added heat burden and the resulting degradation. This provides an advantage of allowing other tubes 160 to operate unperturbed by the event 171, while additionally retaining at least some of the operability of the respective tube 160.

Figure 9:
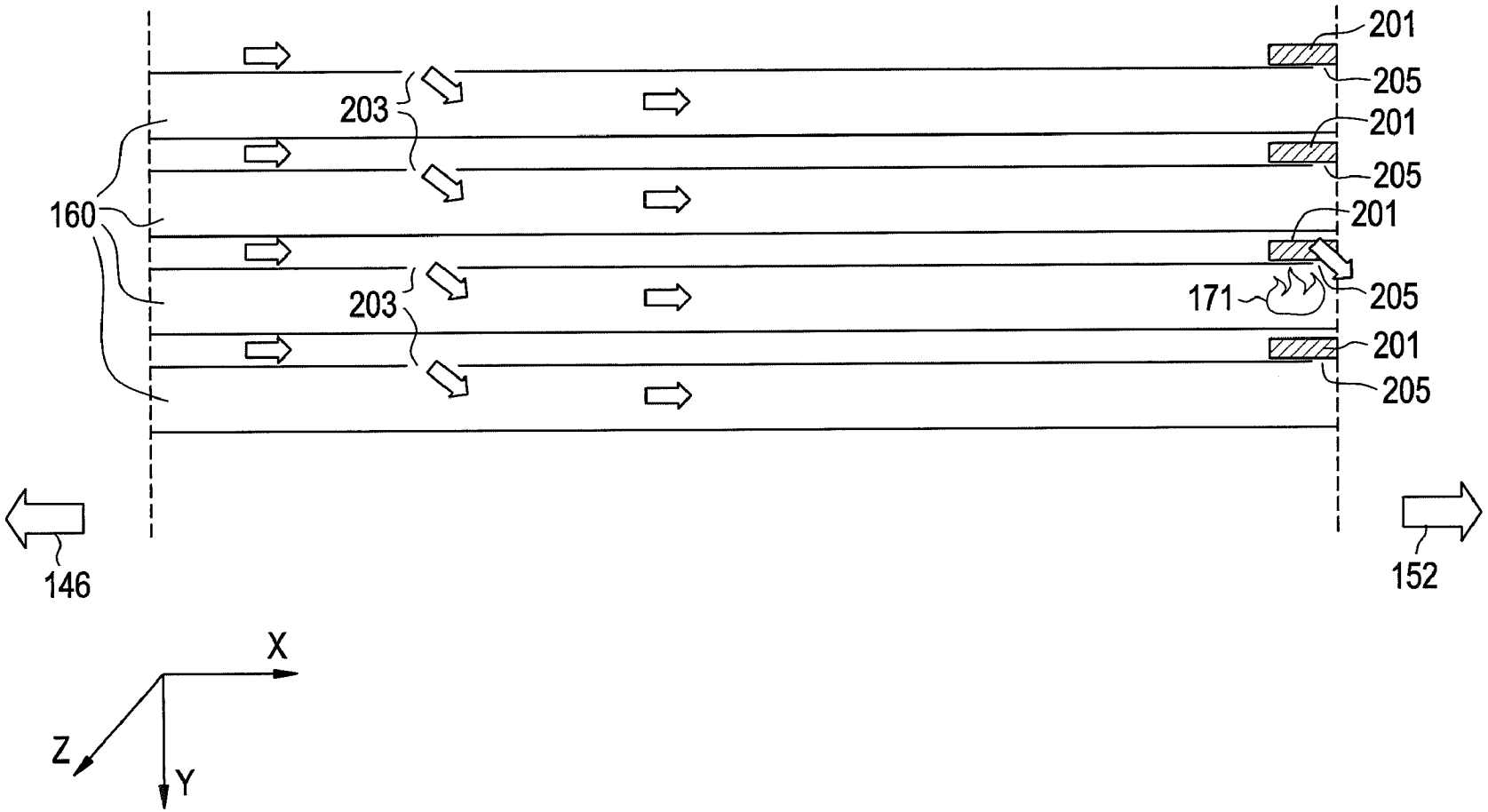

FIG. 9 depicts aspects of another embodiment using the thermal protection features. This embodiment is similar to the embodiment of FIG. 8. The thermal fuses 201 are individually covering downstream bypass openings 205 near the exit of the tube 160 at outlet side 152. This embodiment provides an advantage of allowing unaffected tubes 160 to continue operation as before while reducing a risk of a continued event 171 within the damaged tube 160.

Of course these illustrations are provided for discussion purposes and do not accurately depict operation, size, or scale of nozzle 14.

In general, the thermal fuse 201 is fabricated of a material that has a lower or substantially lower melting temperature than that of the material used for fabrication of each of the tubes 160, the exterior wall 145 and other components as may be proximate to the anomaly 171. In general, the material used for each fuse 201 is selected to melt at a temperature that would provide for substantial protection from degradation of the nozzle 14 as a result of the event 171, while remaining intact during normal operation of the engine 2. Exemplary materials include aluminum, lead, tin, solder, various alloys of such metals and other such materials. Materials may be selected according to a temperature of combustion for the fuel.

The thermal fuse 201 is generally disposed on an exterior surface of each one of the tubes 160. The thermal fuse 201 may at least partially surround the respective tube 160, and may completely encircle the respective tube 160. A single thermal fuse 201 may encircle all the tubes 160, spanning the space between all tubes to the external walls 145 of the fuel plenum space 161. Various embodiments of the thermal fuse 201 are illustrated in FIG. 10.

Figure 10:
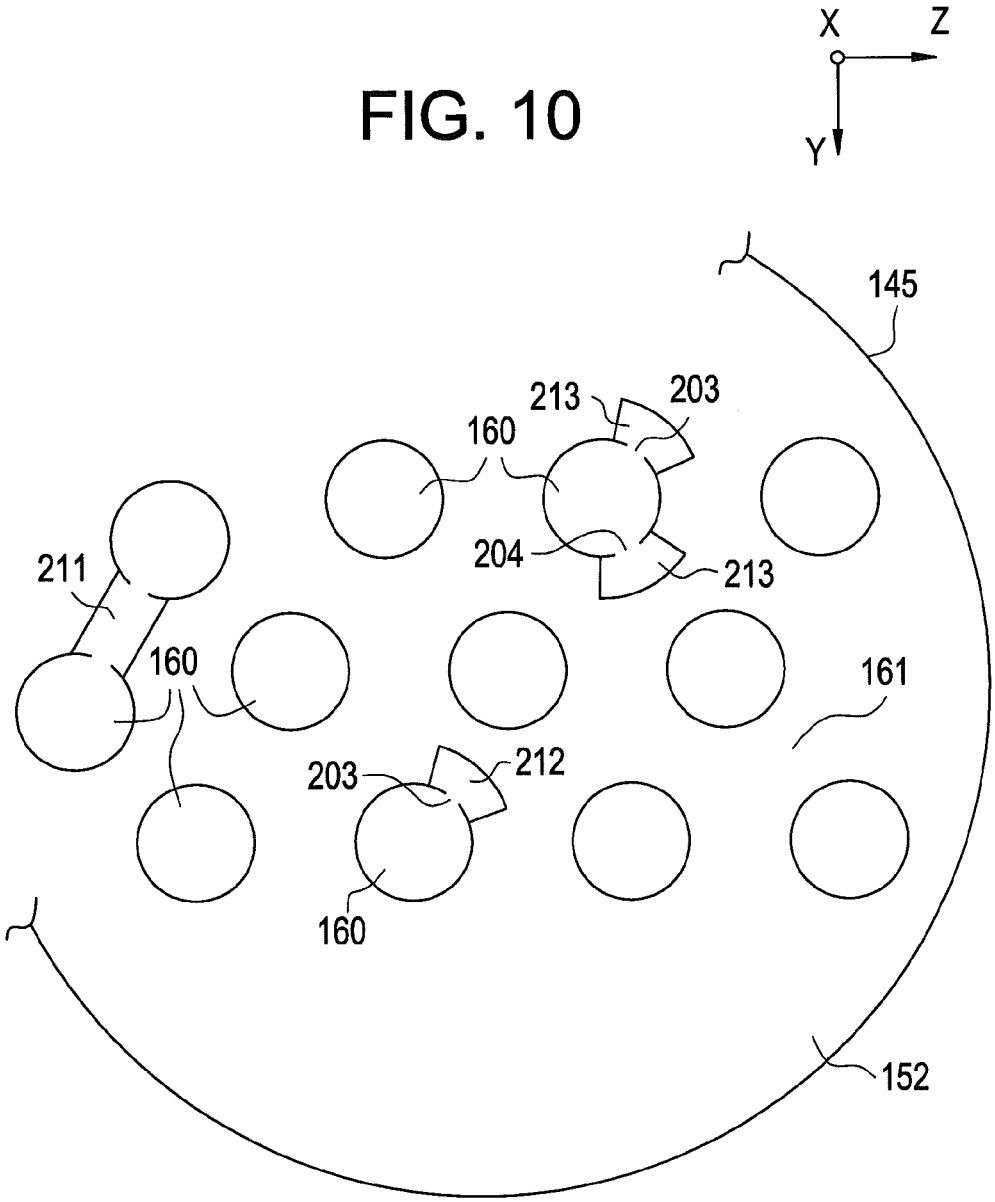

FIG. 10 provides an end-view of a portion of the nozzle 14. In this example, various embodiments of relationships of the thermal fuse 201 are shown. Some of these embodiments may not be suited to co-existing in an application, and accordingly, FIG. 10 is provided for illustration only. In this example, the thermal fuses 201 are shown in relation to selected ones of the tubes 160 and openings used as at least one of the fuel feed opening 203 and the bypass opening 205. For example, a shared thermal fuse 211 is shown. Generally, the shared thermal fuse 211 is provided between at least two tubes 160. In some embodiments, the shared thermal fuse 211 spans the fuel plenum space 161 (the space between all the tubes and extending to the fuel plenum walls 145), as the unitary thermal fuse (see FIGS. 6 and 7). In another example shown in FIG. 10, a separate thermal fuse 212 covers a single bypass opening 205 in each fuel tube 160, and may be realized as the low-profile thermal fuse, thus providing for reduced flow turbulence. In yet another example shown in FIG. 10, a plurality of radial thermal fuses 213 are radially distributed about a single tube 160 each one covering a different opening. Radial thermal fuses 201 may be used, for example, if it is desired to have more then one bypass opening 205 per tube 160.

Figure 11:
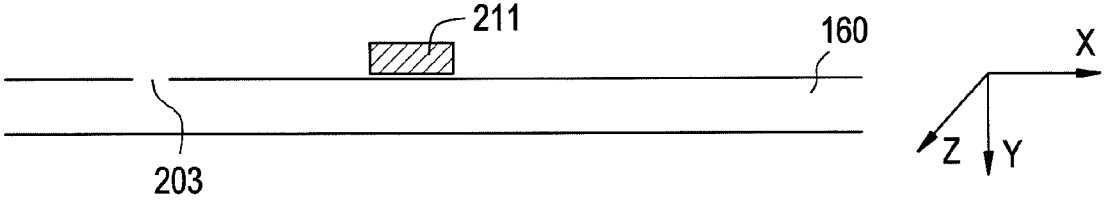
Figure 12:
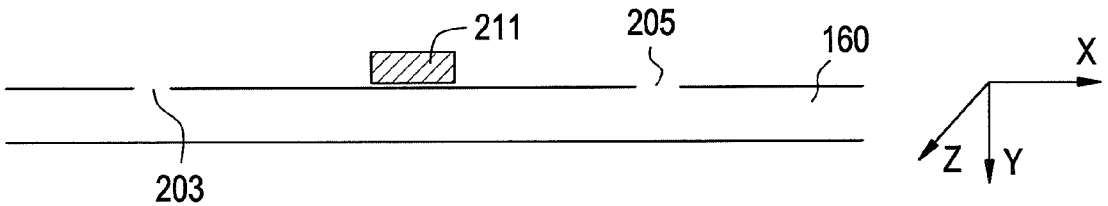
Figure 13:
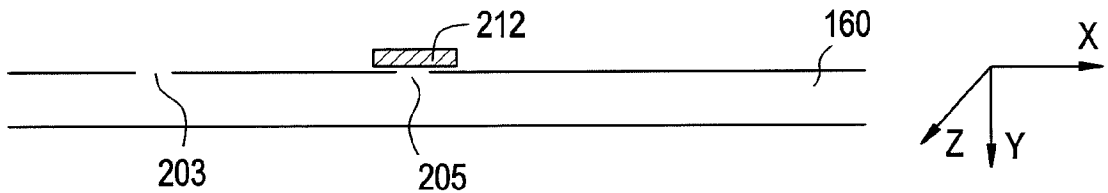

FIG. 11 shows a closeup of a single tube 160 with the shared thermal fuse 211 as might be used in the embodiment shown by FIG. 7. FIG. 12 shows a closeup of a single tube 160 with the shared thermal fuse 211 as might be used in the embodiment shown by FIG. 8. FIG. 13 shows a closeup of a single tube 160 with the separate fuse 212 per tube 160 as might be used in other embodiments described herein.

Having thus established aspects of a multi-tube nozzle 14 and thermal protection for the nozzle 14, it should be recognized that a variety of embodiments may be had. For example, each of the aforementioned openings (the fuel feed opening 203 or the bypass openings 205) may be realized as a single opening or a plurality of openings. The placement of the openings, as well as the placement of the respective thermal fuse(s) 201 may be selected such that mixing characteristics are appropriately controlled once a thermal fuse 201 has blown. As some limited examples, the nozzle 14 may be configured such that fuel dumps out between tubes at the outlet portion 152. Exit dumping may be angled to allow lean-direct-injection style operation. In some embodiments, fuel dumping is designed to provide for some premixing. In further embodiments, fuel dumping is designed to provide for substantial premixing, essentially providing for premixed-direct-injection operation. Accordingly, designers may endeavor to provide designs to control generation of certain combustion by products, such as NOx, and may further take into account fuel types used in the engine 2.

Further, placement of the thermal fuses 201 may be such that presence of the thermal fuse 201 encourages fuel into a respective fuel feed opening 203 (such as placement just after the fuel feed opening 203). A plurality of thermal fuses 201 and bypass openings 205 may be used along the tube 160, such that multiple layers of protection are provided.

Further, although thermal protection is described herein as including the thermal fuse, it should be recognized that the term "fuse" is not limiting. For example, thermal protection may make use of a plug of material, a sheet of material, at least one layer of material, and other forms of material or materials as deemed suitable for providing thermal protection.

In general, this written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of exemplary embodiments of the present invention if they have structural elements that do not differ from the literal language of the claims, or if they include equivalent structural elements with insubstantial differences from the literal language of the claims.

What is claimed is:

1. A protection system for a pre-mixing apparatus for a turbine engine, the system comprising:

a main body having an inlet portion, an outlet portion and an exterior wall that collectively establish at least one fuel delivery plenum; and a plurality of fuel-air mixing tubes that extend from the inlet portion of the main body to the outlet portion of the main body through at least a portion of the at least one fuel delivery plenum, at least one of the plurality of fuel-air mixing tubes comprising at least one fuel feed opening fluidly providing a flow of fuel from the at least one fuel delivery plenum into the at least one fuel-air mixing tube; and at least one thermal fuse disposed on an exterior surface of the at least one fuel-air mixing tube, the at least one thermal fuse comprising a material susceptible to that will melt upon an ignition of fuel within the at least one fuel-air mixing tube, and the at least one thermal fuse to divert the flow of fuel from the at least one fuel delivery plenum into the at least one fuel-air mixing tube, and to allow the flow of fuel from the fuel feed opening to at least one bypass opening of the at least one fuel-air mixing tube.

2. The protection system as in claim 1, wherein the bypass opening is disposed in at least one of the outlet portion and a downstream portion of the at least one fuel mixing tube.

3. The protection system as in claim 1, wherein the at least one thermal fuse comprises at least one of aluminum, lead, tin and a material selected for melting upon the ignition.

4. The protection system as in claim 1, wherein the at least one thermal fuse is disposed over the bypass opening.

5. The protection system as in claim 1, wherein the at least one thermal fuse is shared between at least two of the fuel mixing tubes.

6. The protection system as in claim 1, wherein the thermal fuse comprises a unitary thermal fuse.

7. The protection system as in claim 1, wherein the at least one thermal fuse covers the bypass opening of a single fuel mixing tube.

8. The protection system as in claim 1, wherein melting of the at least one thermal fuse provides for redirection of fuel to cause one of lean-direct-injection of the fuel, some pre-mixing of the fuel, and premixed-direct-injection of the fuel.

9. A method of fabricating a pre-mixing apparatus for delivering fuel to a combustion chamber, the method comprising:

selecting a pre-mixing apparatus comprising a main body having an inlet portion, an outlet portion and an exterior wall that collectively establish at least one fuel delivery plenum, and a plurality of fuel-air mixing tubes that extend from the inlet portion of the pre-mixing apparatus to the outlet portion of the pre-mixing apparatus through at least a portion of the at least one fuel delivery plenum, at least one of the plurality of fuel-air mixing tubes comprising at least one fuel feed opening providing a flow of fuel from the at least one fuel delivery plenum into the at least one fuel-air mixing tube;

selecting a fuse material for installing at least one thermal fuse into the pre-mixing apparatus; and placing at least one thermal fuse on an exterior surface of the at least one fuel-air mixing tube of the pre-mixing apparatus, wherein the at least one thermal fuse comprises a material susceptible to melt upon an ignition of fuel within the at least one fuel-air mixing tube, and the at least one thermal fuse diverts the flow of fuel from the at least one fuel delivery plenum into the at least one fuel-air mixing tube, and diverts the flow of fuel from the fuel feed opening to at least one bypass opening of the at least one fuel-air mixing tube.

10. The method of claim 9, further comprising disposing at least one bypass opening at a location selected for receiving fuel upon an activation of the at least one thermal fuse.

11. The method of claim 10, wherein the location comprises at least one of a downstream portion of the at least one fuel mixing tube and the outlet portion.

12. The method of claim 9, wherein the selecting comprises identifying fuse material that comprises a melting point that is exceeded upon reaching a temperature for ignition of fuel within the pre-mixing apparatus.

13. The method of claim 9, wherein the selecting comprises identifying fuse material that comprises a melting point that is not reached during normal operation of the pre-mixing apparatus.

14. The method of claim 9, further comprising disposing at least one of a bypass opening and the thermal fuse according to a performance characteristic of the turbine upon melting of the thermal fuse.

15. A turbine engine comprising:

at least one source of fuel;

at least one source of combustion air;

an apparatus for mixing the fuel with the combustion air, the apparatus comprising a main body having an inlet portion, an outlet portion and an exterior wall that collectively establish at least one fuel delivery plenum, and a plurality of fuel-air mixing tubes that extend from the inlet portion of the apparatus to the outlet portion of the apparatus through at least a portion of the at least one fuel delivery plenum, at least one of the plurality of fuel-air mixing tubes comprising at least one fuel feed opening fluidly providing a flow of fuel from the at least one fuel delivery plenum into the at least one fuel-air mixing tube; and at least one thermal fuse disposed on an exterior surface of at least one fuel mixing tube, the at least one thermal fuse comprising a material susceptible to melt upon an ignition of fuel within the at least one fuel-air mixing tube, and the at least one thermal fuse to divert the flow of fuel from the at least one fuel delivery plenum into the at least one fuel-air mixing tube, and to allow the flow of fuel from the fuel feed opening to at least one bypass opening of the fuel-air mixing tube.

16. The turbine engine as in claim 15, wherein the fuel is selectively delivered to the fuel delivery plenum, passed through the at least one fuel feed opening and mixed with the combustion air flowing through at least a portion of the plurality of fuel mixing tubes prior to being combusted in a combustion chamber of the turbine engine.

17. The turbine engine as in claim 15, wherein the diversion provides for one of lean-direct injection and premixed direct injection of the fuel.

* * * * *